US007076902B2

(12) United States Patent
Hengstenberg et al.

(10) Patent No.: US 7,076,902 B2
(45) Date of Patent: Jul. 18, 2006

(54) FIRING SYSTEM FOR A FIREARM

(75) Inventors: Eric Hengstenberg, Cincinnati, IA (US); Howard D. Carr, Ames, IA (US); Steven J. Winter, Pella, IA (US); Jerald M. Vogel, Ames, IA (US); Vinay Dayal, Ames, IA (US)

(73) Assignee: Knight Rifle, Inc., Centerville, IA (US)

( * ) Notice: Subject to any disclaimer, the term of this patent is extended or adjusted under 35 U.S.C. 154(b) by 14 days.

(21) Appl. No.: 10/648,996

(22) Filed: Aug. 27, 2003

(65) Prior Publication Data

US 2004/0128899 A1 Jul. 8, 2004

(51) Int. Cl.
*F41C 7/00* (2006.01)

(52) U.S. Cl. ..... 42/51; 42/69.01; 42/69.03

(58) Field of Classification Search ..... 42/51, 42/69.01, 69.03
See application file for complete search history.

(56) References Cited

U.S. PATENT DOCUMENTS

| | | | | |
|---|---|---|---|---|
| 802,033 | A | 10/1905 | Freeman | |
| 2,765,561 | A * | 10/1956 | Morris | 42/69.01 |
| 2,961,791 | A * | 11/1960 | Morris | 42/16 |
| 3,092,924 | A * | 6/1963 | Seecamp | 42/22 |
| 3,797,154 | A | 3/1974 | Seecamp | |
| 3,949,508 | A | 4/1976 | Elkas | |
| 4,570,369 | A | 2/1986 | Gerfen | |
| 4,841,840 | A | 6/1989 | Agner et al. | |
| 5,417,001 | A | 5/1995 | Rousseau | |
| 5,463,828 | A | 11/1995 | Andrejevic | |
| 5,463,829 | A | 11/1995 | Sprangers | |
| 5,659,992 | A | 8/1997 | Mistretta | |
| 5,678,341 | A | 10/1997 | Kahnke | |
| 5,682,699 | A | 11/1997 | Gentry | |
| 5,722,193 | A | 3/1998 | Post | |
| 6,272,783 | B1 | 8/2001 | Dumortier et al. | |
| 6,305,113 | B1 | 10/2001 | Calvete | |
| 6,360,467 | B1 | 3/2002 | Knight | |
| 6,532,692 | B1 | 3/2003 | Cate | |
| 6,604,311 | B1 | 8/2003 | Laney et al. | |
| 6,615,527 | B1 | 9/2003 | Martin | |
| 6,722,072 | B1 * | 4/2004 | McCormick | 42/75.03 |
| 6,922,932 | B1 * | 8/2005 | Hengstenberg et al. | 42/51 |
| 2004/0134112 | A1 * | 7/2004 | Lizarralde et al. | 42/51 |

* cited by examiner

*Primary Examiner*—M. Clement
(74) *Attorney, Agent, or Firm*—Brett Trout

(57) ABSTRACT

An improved action for a muzzleloading firearm which allows loading an ignition system from above, and completely releasing the action from below. The system covers the ignition system during firing to shield the user and the line of sight. The action may be removed in the field for inspection, cleaning or repair, without the need for tools.

20 Claims, 13 Drawing Sheets

FIRING SYSTEM FOR A FIREARM

BACKGROUND OF THE INVENTION

1. Field of the Invention

The present invention relates in general to a firing system for a firearm and, more particularly, to a firing system for a muzzleloading firearm.

2. Description of the Prior Art

It is known in the art of muzzleloading firearms to provide a nipple upon which is positioned a percussion cap used to ignite a power charge, thereby discharging a projectile. It is also known in the art to provide flint or primers to ignite the powder charge. One drawback associated with typical muzzleloading ignition systems is the exposure of the ignition system to the elements. Moisture and debris can incapacitate an ignition system, while wind and other environmental elements contacting the ignition system can dislodge the ignition system, preventing firing of the weapon.

Another drawback associated with the prior art is the shock, smoke and debris expelled from the ignition system being directed upward toward the shooter's face. Not only does such debris cause a hazard to the eyes of the shooter, but such debris can also cause the shooter to develop a flinch, as well as briefly obstruct the shooter's view of the target. While firing mechanisms such as that described in Post, U.S. Pat. No. 5,722,193, direct the ignition blast away a shooter's face, such systems do not shield the workings of the firing system, allowing shrapnel from the ignition system to permeate the firing system, requiring more frequent cleaning of the firing system to avoid a malfunction.

Yet another drawback associated with the prior art is the location of the access to the ignition system. Access to the ignition system in most prior art systems is from above, which often prevents the utilization of a scope or similar optics. While it would be desirable to protect an ignition system from the elements, prior art systems which shield the ignition system are often difficult to field strip and clean. It would also be desirable to allow for the ignition and firing systems to be easily accessed in the field.

It would be desirable to provide an enclosed ignition and firing system which directs shrapnel and debris from the ignition downward, away from the shooter's face, allows the mounting of a scope or similar optics, and allows field stripping of the mechanism, while maintaining a high level of safety in operation. The difficulties in the prior art discussed hereinabove are substantially eliminated by the present invention.

SUMMARY OF THE INVENTION

In an advantage provided by this invention, a firing system is provided which directs smoke and debris away from a shooters face.

Advantageously, this invention provides a firing system which shields a firing mechanism for a firearm from moisture and other elements.

Advantageously, this invention provides a positive engagement ignition system for a firearm which reduces smoke and debris associated with ignition.

Advantageously, this invention provides a firing system for a firearm which prevents undesired contact with the ignition system prior to firing.

Advantageously, this invention provides a firing system for a firearm which is quick and easy to operate.

Advantageously, this invention provides for a firing system for a muzzleloading firearm which allows the use of a scope or similar optics.

Advantageously, this invention provides a firing system for a firearm which is capable of being field stripped and cleaned without the requirement of additional tools.

Advantageously, this invention provides a firing system for a firearm which reduces the collection of soot and other debris in the firing mechanism.

Advantageously, this invention provides a firing system for a firearm with a plurality of safety mechanisms.

Advantageously, in a preferred example of this invention, an improved action is provided for a firearm having a grip, a receiver, a forwardly extending barrel and a trigger assembly. The improvement comprises a frame and a hammer pivotably coupled to the frame. Means are provided on a carriage for releasably engaging the hammer when the carriage is pivoted a first direction, and for releasing the hammer when the carriage is pivoted in an opposite, second direction. Means are also provided for pivotably coupling the carriage to the frame in manner which allows the carriage to disengage from the frame upon pivoting the carriage a predetermined angle relative to the frame.

Preferably, the carriage is pivotable between the first position which protects the ignition system from the elements and second position, allowing for access to, removal and reinsertion of the ignition system.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
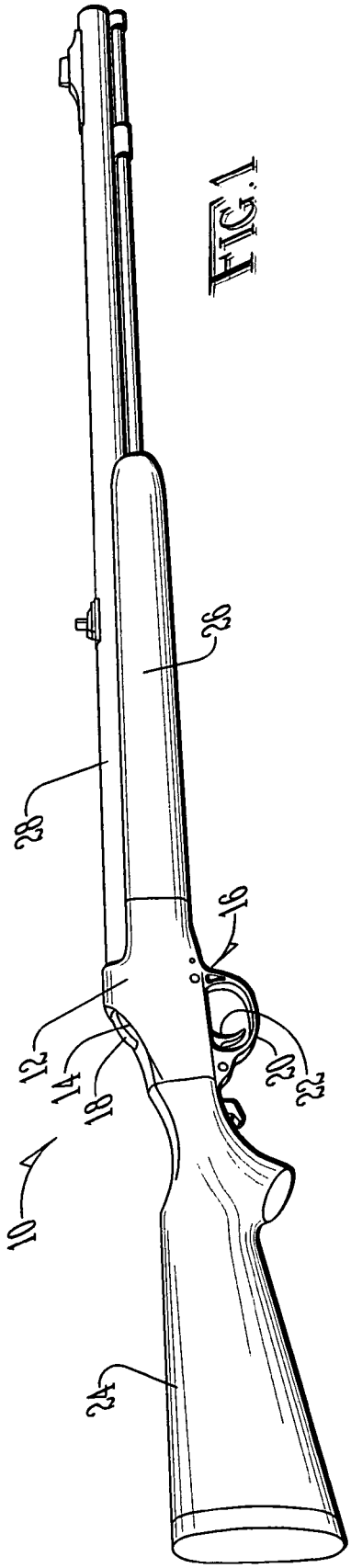
FIG. 1 illustrates a rear perspective view of the improved firearm of the present invention.

Referring to FIG. 1, a firearm (10) according to this invention is shown with a frame (12), preferably constructed of stainless steel or similar material. The frame (12) is preferably provided with an upper aperture (14) and a lower aperture (16). Extending through the upper aperture (14) is a portion of the carriage assembly (18), described in more detail below. Extending through the lower aperture (16) is the trigger guard (20) and trigger (22). As shown in FIG. 1, the frame (12) connects a grip, such as a rear stock (24) to the front stock (26) and barrel (28).

Figure 2:
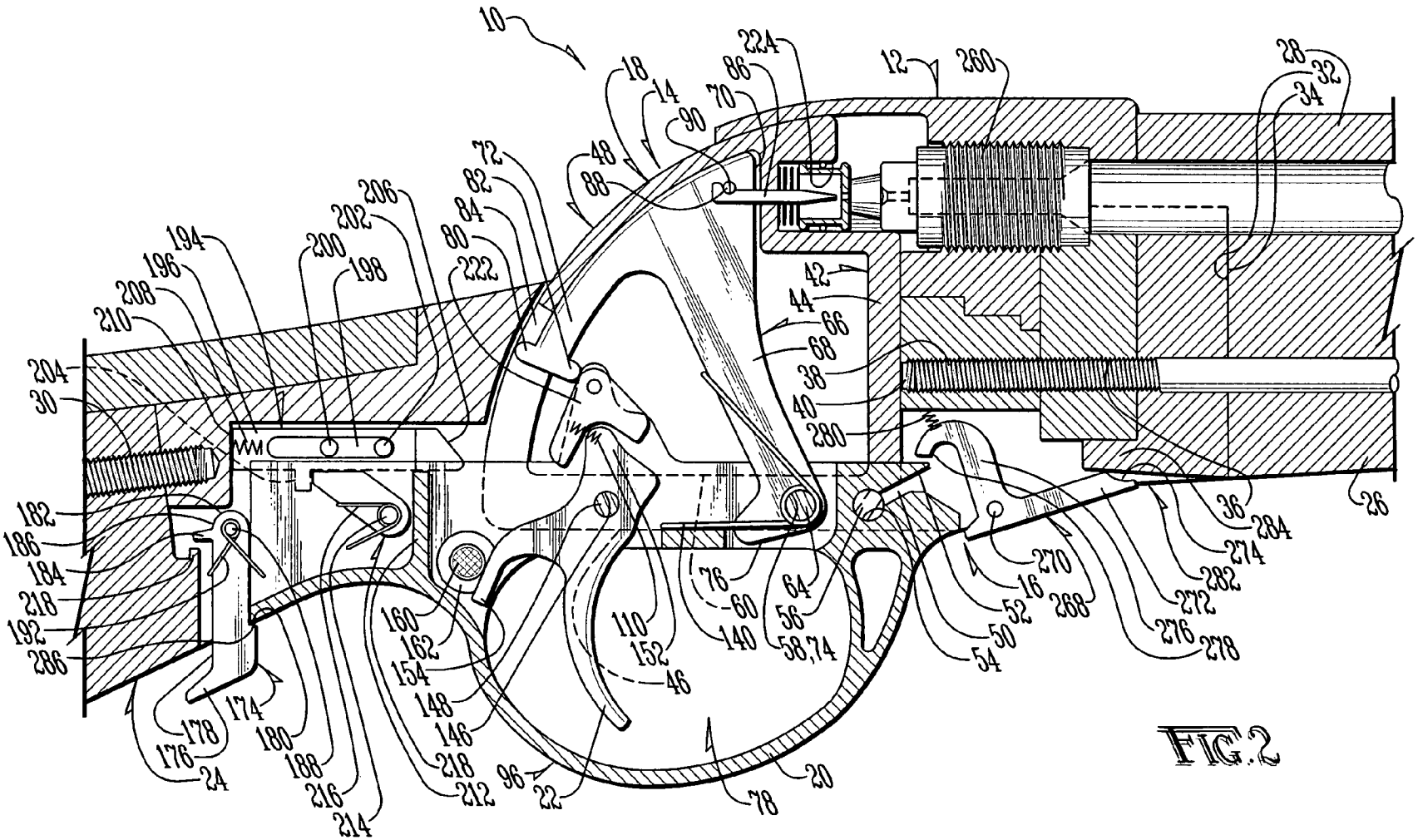
FIG. 2 illustrates a side elevation in cross-section of the improved action of the firearm of FIG. 1, shown in the initial position.

As shown in FIG. 2, the rear stock (24) is coupled to the frame (12) by a rear stock retaining screw (30) in a manner such as that known in the art. Similarly, the front stock (26) is provided with a slot (32), configured to receive a lug (34) constructed of stainless steel, with a rectangular cross-section. The lug (34) is welded or otherwise secured directly to the barrel (28). The lug (34) is provided with a threaded hole (36) which receives a forward retaining screw (38), which is threadably received in a hole (40) provided on the frame (12) to retain the barrel (28) and front stock (26) in engagement with the frame (12).

Figure 3:
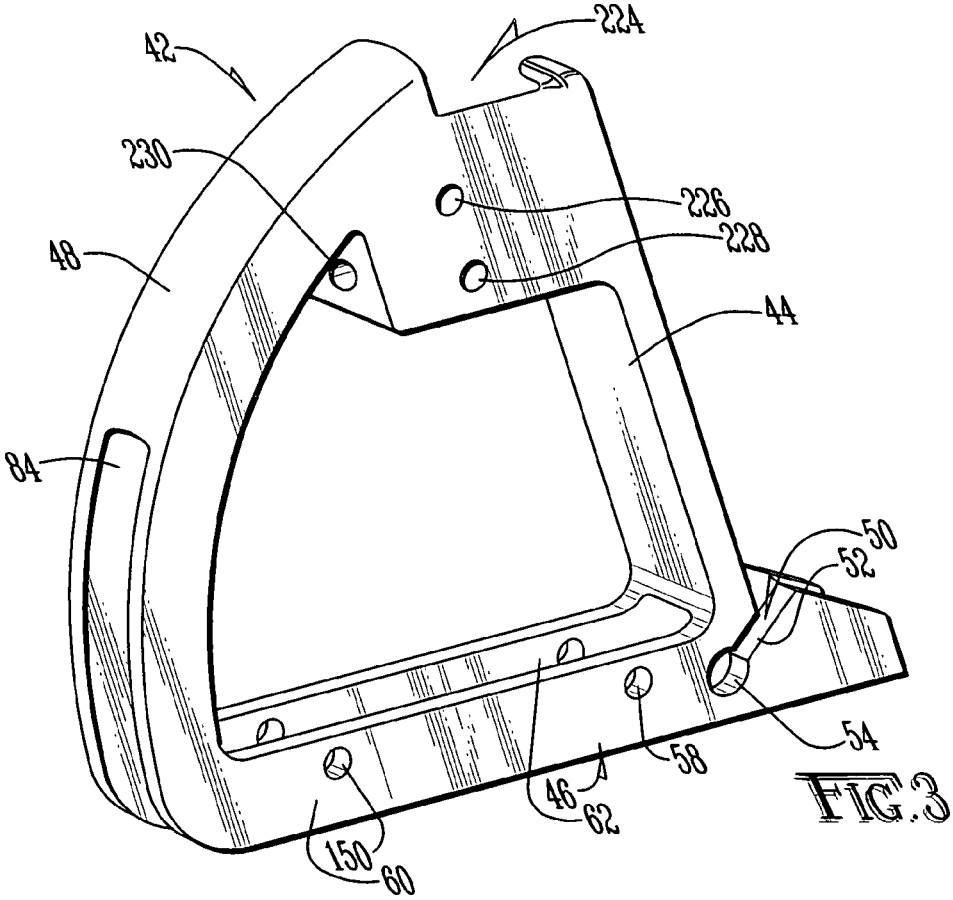
FIG. 3 illustrates a rear perspective view of the carriage of the improved action of FIG. 2.

As shown in FIGS. 2–3, the carriage assembly (18) contains the entire firing assembly, including a carriage (42), preferably constructed of 10/20 steel hardened to Rockwell 55. The carriage (42), of course, may be constructed of any suitable material known in the art. As shown in FIG. 3, the carriage (42) includes a front plate (44), a bottom plate pair (46) and a back strap (48). Provided on the bottom plate pair (46) are a plurality of holes and a slot (50). The slot (50) is preferably cut at a forty-five degree angle, with parallel walls (52) opening to a circular recess (54), having a diameter greater than the distance between the walls (52). Means are provided for pivotably coupling the carriage assembly (18) to the frame (12) in a manner which allows the carriage assembly (18) to disengage from the frame (12) upon pivoting the carriage assembly (18) a predetermined angle in relation to the frame (12). As shown in FIG. 2, this pivotable coupling means is a flat-sided pin (56), provided through the circular recess (54). The flat-sided pin (56) which has a diameter across a first dimension only slightly smaller than the diameter of the circular recess (54), and a distance across a transverse direction only slightly smaller than the distance between the walls (52) of the slot (50). Preferably, this narrower distance is maintained across the entire dimension of the flat-sided pin (56), allowing the carriage assembly (48) to be removed from the frame (12) when the carriage assembly (18) is rotated a predetermined angle relative to the frame (12). The flat-sided pin (56) is secured to the frame (12) in such a manner that the carriage assembly (18) must be rotated in excess of forty-five degrees before the flat-sided pin (56) is in proper alignment with the walls (52) of the slot (50) to allow the carriage assembly (18) to be removed from the frame. The flat-sided pin (56) is frictionally engaged with the frame (12) to prevent rotation of the flat-sided pin (56) relative to the frame (12). Rotation of the flat sided pin (56) would prevent the desired removal of the carriage assembly (18) from the frame (12) upon rotation to the predetermined angle.

The bottom plate pair (46) is provided with a pair of receiving holes (58). As the bottom plate pair (46) is also provided with a first sidewall (60) and a second sidewall (62), one of the receiving holes (58) is provided in each one of the sidewalls (60) and (62) in a manner so as to receive a pin (64). The pin (64) is provided with a diameter only slightly smaller than that of the receiving holes (58) to provide a frictional fit therein, and to prevent rotation of the pin (64) relative to the sidewalls (60) and (62) of the bottom plate pair (46) of the carriage (42).

As shown in FIG. 2, the firearm (10) is provided with a hammer (66), preferably constructed of 10/18 steel hardened to Rockwell 55. The hammer (66) is provided with a shaft (68), a head (70) and a tail (72). Provided on the shaft (68) is a bore (74), sized slightly larger than the diameter of the pin (64). The diameter of the bore (74) is slightly larger than the diameter of the receiving holes (58) to allow pivotal movement of the hammer (66) around the pin (64) without rotating the pin (64) relative to the receiving holes (58). Integrally formed into the tail (72) of the hammer (66) is a nib (76). As shown in FIG. 2, the nib (76) is preferably constructed of a length, dimension and orientation so that as the hammer (66) is cocked, the nib (76) protrudes into the finger area (78), defined by the trigger guard (20), and retracts from the finger area (78) when the hammer (66) is no longer cocked. The tail (72) is provided with an outward catch (80) and an inward catch (82). As shown in FIGS. 2 and 3, the back strap (48) of the carriage (42) is provided with a slot (84) through which the outward catch (80) of the hammer (66) protrudes.

As shown in FIG. 2, the head (70) of the hammer (66) is provided with a firing pin (86), such as those known in the art, retained on the hammer (66) by a pin (88), which engages a scallop (90), provided on the firing pin (86). The length of the firing pin (86) is preferably sufficient to detonate, but insufficient to puncture, a primer.

Figure 4:
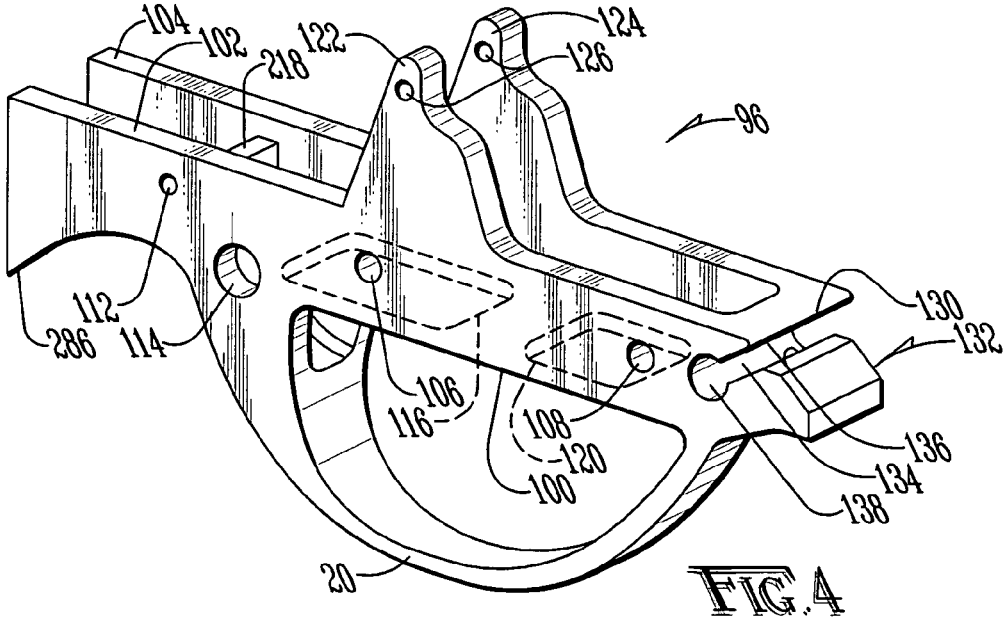
FIG. 4 illustrates a front perspective view in partial phantom of the trigger guard assembly of the improved action of FIG. 2.

As shown in FIG. 4, the trigger guard assembly (96) includes the trigger guard (20), a base plate (100) and a pair of side plates (102) and (104). The base plate (100) is preferably provided with two holes (106) and (108) to accommodate the trigger (22) and nib (76) of the hammer (66) respectively. Similarly, the side plates (102) and (104) are provided with a plurality of hole pairs (112), (114), (116) and (120). The side plates (102) and (104) are provided with risers (122) and (124) integrally formed therewith. The risers (122) and (124) are also provided with a hole pair (126). As shown in FIG. 4, the trigger guard assembly is provided with a front face (130) and a stop (132) which coact to form a slot (134) to accommodate the slotted pin (56). (FIGS. 2–4).

The slot (134) comprises a pair of walls (136) and a circular recess (138) similar in dimension to the walls (52) and circular recess (54) described above in association with the carriage (42). As shown in FIG. 2, the trigger guard assembly (96) is positioned within the carriage (42) and pinned in place by the various pin placements described above and below. A double torsion spring (140) is provided around the flat sided pin (56) biased between the back (142) of the hammer (66) and the base plate (100) of the trigger guard assembly (96).

Figure 5:
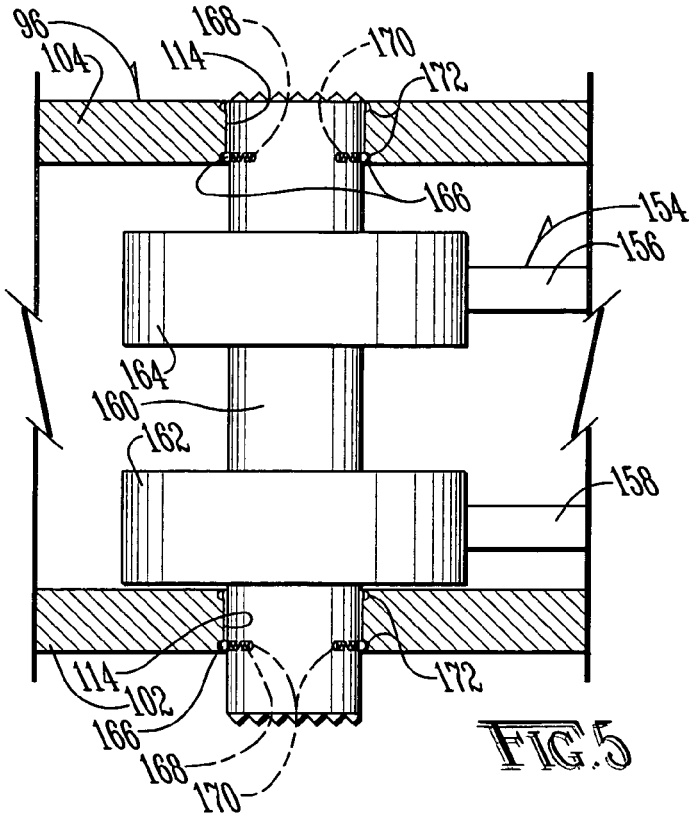
FIG. 5 illustrates a top elevation in cross-section of the safety mechanism of the improved action of FIG. 2, shown in the safe position.

As shown in FIG. 2, the trigger (22) is provided with a hole (146) to receive a pin (148), which also passes through the hole pair (150) in the carriage (42) and the hole pair (116) in the trigger guard assembly (96). (FIGS. 2–4). The trigger (22) is also provided with a sear engagement head (152) and a safety tail (154), including two safety fingers (156) and (158). (FIGS. 2 and 5). As shown in FIG. 5, a safety pin (160) is provided through the hole pair (114) in the trigger guard assembly (96). The safety pin (160) is provided with a pair of rings (162) and (164), welded or otherwise secured to the safety pin (160). The safety pin (160) is provided with a plurality of spring loaded balls (166), motivated by springs (168), provided in recesses (170) in the safety pin (160). As shown in FIG. 5, the balls (166) ride in detents (172) provided in the trigger guard assembly (96). The system is preferably designed to allow the safety pin (160) to be shifted from the position shown in FIG. 5 to the position shown in FIG. 6, with the mechanism engaging the safety pin (160) in the desired orientation until specifically moved therefrom.

Figure 6:
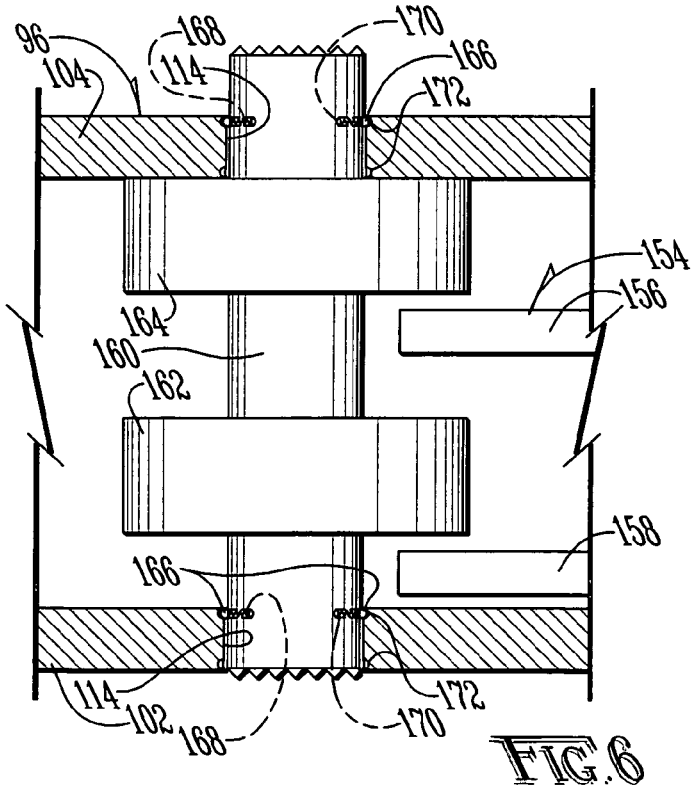
FIG. 6 illustates a top elevation in cross-section of the safety mechanism of the improved action of FIG. 2 shown in the fire position.

As shown in FIGS. 5 and 6, when the safety pin (160) is in the position shown in FIG. 5, the rings (162) and (164) prevent the fingers (156) and (158) of the trigger (22) from rotating past the safety pin (160), thereby preventing rotation of the trigger (22) itself. However, when the safety pin (160) is moved into the position designated in FIG. 6, the rings (162) and (164) are moved out of the way, thereby allowing the fingers (156) and (158) to pass, and the trigger (22) to rotate. Of course, any desired safety mechanism known in the art may be utilized to prevent actuation of the trigger.

Figure 7:
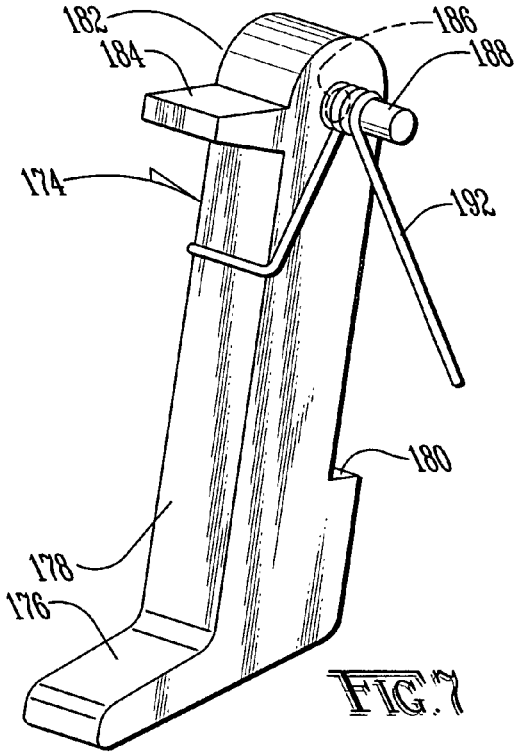
FIG. 7 illustrates a rear perspective view of the rear carriage catch of the improved action of FIG. 2.

As shown in FIG. 7, a rear carriage catch (174) is provided with a tab (176), a body (178) having a keeper (180), a head (182), a beak (184) and a hole (186). Provided through the hole (186) is a pin (188), secured through the hole (186) to the frame (12). (FIGS. 2 and 7). Provided around the pin (188) is a double a torsion spring (192) biased between the body (178) of the rear carriage catch (174) and the frame (12). As shown in FIG. 7, the double torsion spring (192) extends around the pin (188) and around the body (178), back around the pin (88) and back to the frame (12), in a manner which motivates the rear carriage catch (174) in a counter-clockwise direction. Alternatively, any desired resilient motivation or securement may be utilized to maintain the rear carriage catch (174) in a closed position.

As shown in FIG. 2, a hammer catch (194) is provided with a wide body (196), having a center slot (198). The slot (198) is provided around a pair of pins (200) and (202) having a diameter only slightly less than the height of the slot (198). The pins (200) and (202) are preferably secured to the frame (12) to allow the hammer catch (194) to slide forward and reverse, along a substantially even plane. Depending from the body (196) is a catch block (204). Extending forward from the body (196) is an integrally formed tapered nose (206), which is preferably narrow enough to extend between the slot (84) provided in the carriage (42). (FIGS. 2–3). The hammer catch (194) is preferably motivated into a forward orientation by a spring (208) coupled between a tail (210) of the hammer catch (194) and the rear pin (200). Of course, any suitable motivation mechanism may be utilized.

As shown in FIG. 2, a release lever (212) is pivotally secured to the trigger guard assembly (96) by a pin (214) secured within the hole pair (112). The release lever (212) is preferably motivated in a clockwise direction by a torsion spring (216) secured between the release lever (212) and the frame (12) around the pin (214). A stop (218) is preferably welded or otherwise secured to the frame (12) to prevent over rotation when the release lever (212) is actuated. Pivotally secured to the trigger guard assembly (96) by a pin (220) secured through the hole pair (126) is a sear (222). The sear is preferably motivated in a clockwise rotation by a compression spring (110) secured within recesses provided within the sear (222) and the sear engagement head (152) of the trigger (22).

Figure 8:
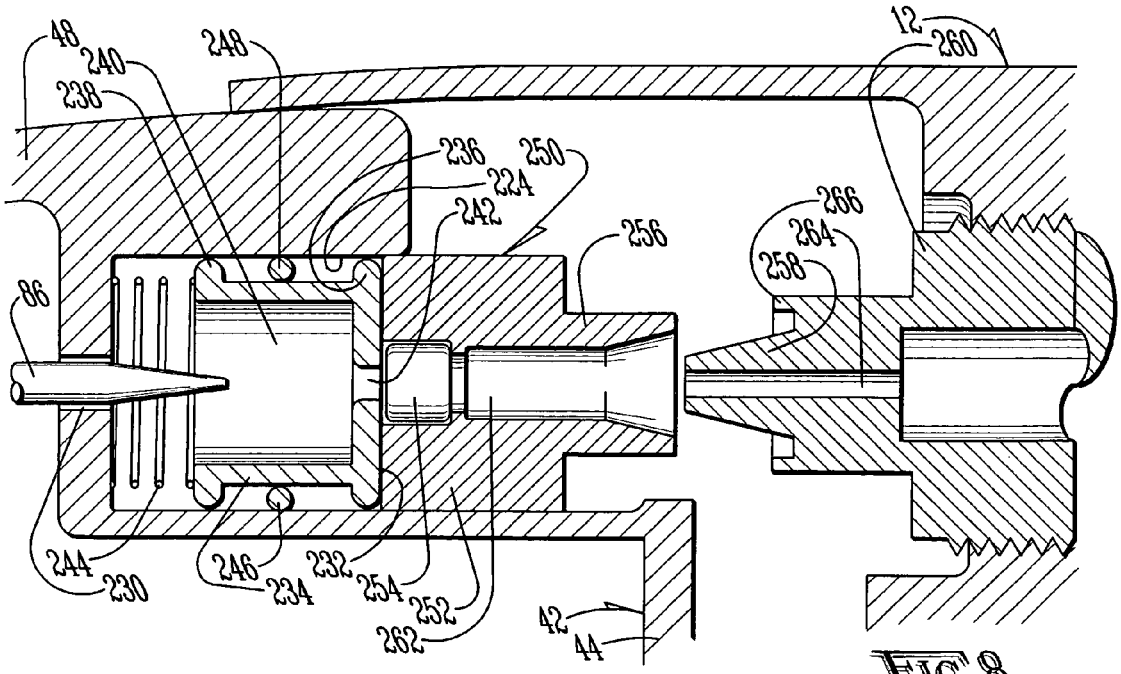
FIG. 8 illustrates a side elevation in cross-section of the retractable face assembly of the improved action of FIG. 2, shown in the safe position.
Figure 9:
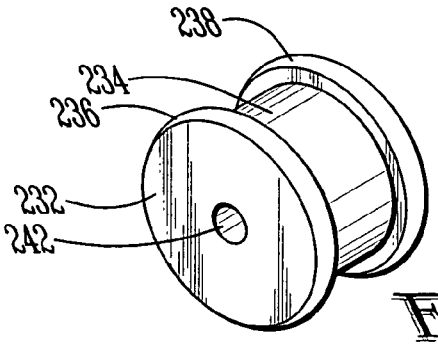
FIG. 9 illustrates a front perspective view of the retractable face of the retractable face assembly of FIG. 8.

Provided near the top of the carriage assembly (18) is a primer pocket (224), provided with two hole pairs (226) and (228). (FIG. 3) A hole (230) is also provided in the rear of the primer pocket (224). As shown in FIG. 8, provided within the primer pocket (224) is a retractable face (232). As shown in FIG. 9, the retractable face is preferably a hollow, open-bottomed spool having a barrel (234), a front flange (236) and a rear flange (238). As shown in FIG. 8, the rear flange (238) does not obstruct entry into the interior (240) of the barrel (234), while the front flange (236) covers the barrel (234) except for a small hole (242), having a diameter twice the widest diameter of the firing pin (86). While the retractable face (232) may be constructed of any suitable material, in the preferred embodiment it is constructed of stainless steel, and is preferably covered with Teflon® or similar low friction material to allow the retractable face (232) to move back and forth within the primer pocket (224). As shown in FIG. 8, the retractable face (232) is biased toward a forward orientation by a compression spring (244), which contacts the rear flange (238). A pair of pins (246) and (248) extend through the hole pairs (226) and (228) in the primer pocket (224). By engaging the front of the rear flange (238), the pins (246) and (248) maintain the retractable face (232) within the primer pocket (224).

Figure 10:
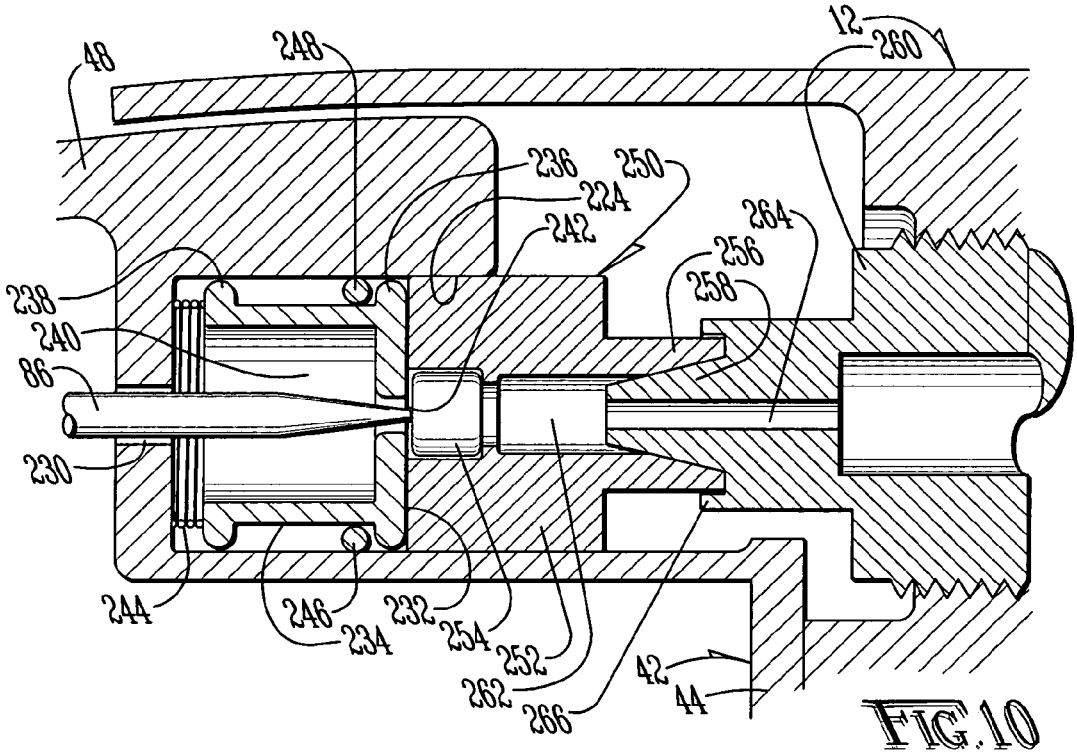
FIG. 10 illustrates a side elevation in cross-section of the retractable face assembly of FIG. 8, shown in the fire position.

As shown in FIG. 8, in the preferred embodiment, an ignition system (250) comprising a plastic jacket (242) and a primer (254) is provided. While any ignition system of suitable dimensions may be used, in the preferred embodiment, a full plastic jacket such as that sold by Knight Rifles of Centerville, Iowa is utilized in association with a 209 Primer, such as that known in the art for use in association with muzzleloaders. As shown in FIG. 8, the primer (254) is inserted into the jacket (252). The ignition system (250) is provided in front of the retractable face (232) in a manner described in more detail below. As shown in FIG. 8, when the ignition system (250) rests in front of the retractable face (232), the spring (244) motivates the retractable face (232) into a forward position, maintaining the primer (254) out of reach of the firing pin (86). The firing pin (86) remains out of reach until the carriage (42) and primer pocket (224) are rotated into battery, where the sleeve (256) encircles the nipple (258) of the breech plug (260). As the carriage (42) rotates, the nipple (258) motivates the sleeve (256) outward, placing the bore (262) in airtight communication with the bore (264) of the breech plug (260). The breech plug (260) may also be provided with a lip (266) to prevent the escape of gasses during ignition. As the carriage (42) rotates, the breech plug (260) prevents the sleeve (256) of the jacket (252) from moving forward with the carriage (42). The carriage (42) continues to rotate, compressing the spring (244) until the ignition system (250) is to a point where upon release of the hammer (66), the firing pin (86) is capable of engaging and igniting the primer (254). (FIGS. 2 and 10).

Figure 11:
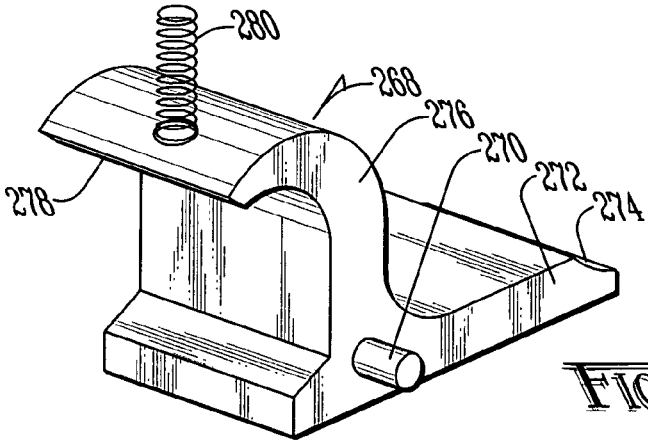
FIG. 11 illustrates a rear perspective view of the forward carriage release of the improved action of FIG. 2.

A forward carriage release (268) is shown in FIG. 2, pivotably coupled to the frame (12) by a pin (270). As shown in FIG. 11, the forward carriage release (268) includes a bottom plate (272) provided with a finger recess (274). The forward carriage release (268) is also provided with an upwardly extending neck (276), curving laterally toward a catch plate (278). The forward carriage release (268) is resiliently motivated into a counter-clockwise rotation by a compression spring (280), secured within recesses provided within the catch plate (278) and the frame (12). (FIGS. 2 and 11). As shown in FIG. 2, the frame (12) is provided with a recess (282), formed by an overhang (284). The overhang (284) prevents the forward carriage release (268) from over rotating. Although the catch plate (278) of the forward carriage release (268) may be of any suitable design or configuration, it is preferably designed to engage the stop (132) of the trigger guard assembly (96) to prevent over rotation of the trigger guard assembly (96).

Figure 12:
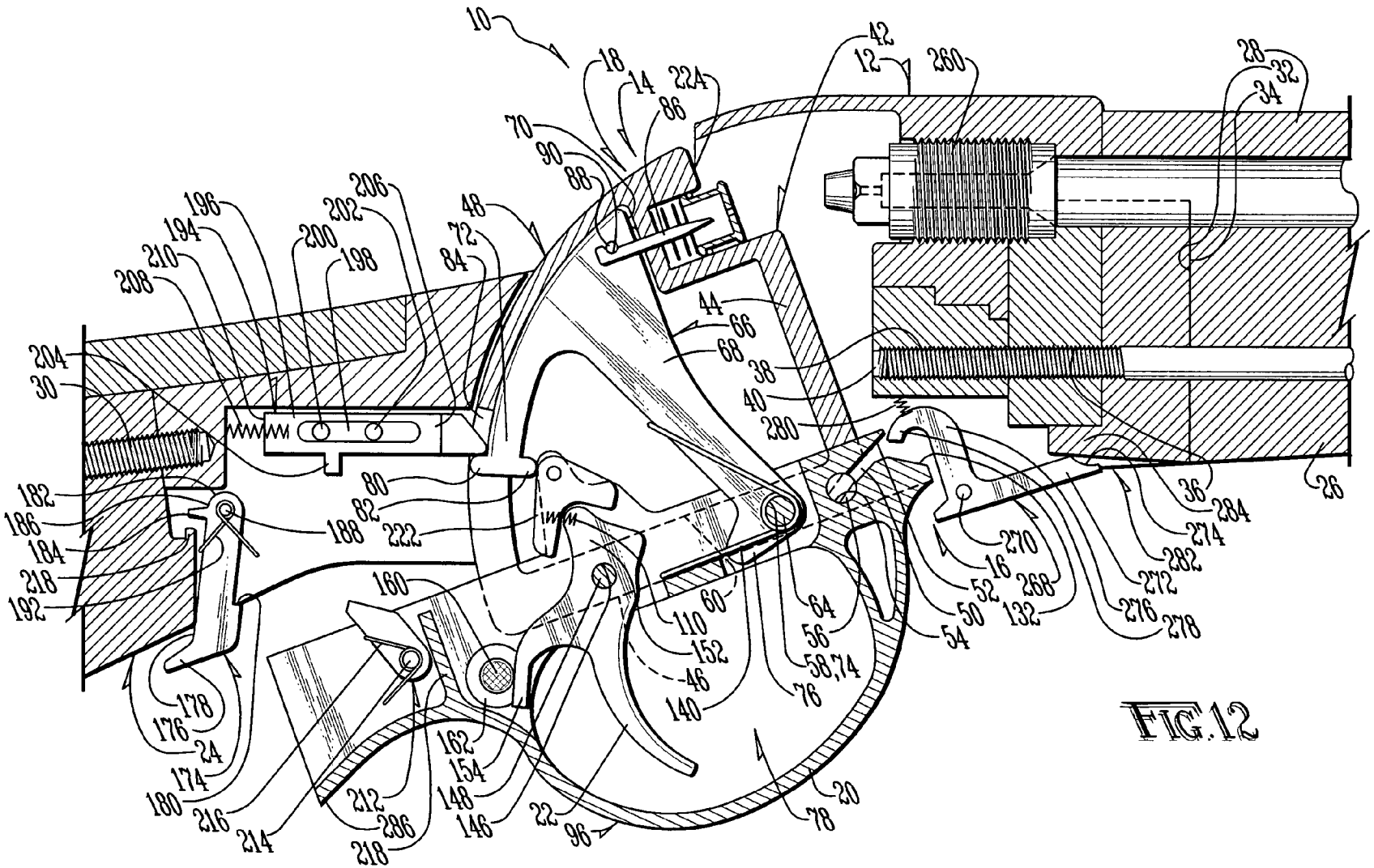
FIG. 12 illustrates a side elevation in cross-section of the improved action of FIG. 1, showing the action being cocked.

When it is desired to utilize the firearm (10) of the present invention, the tab (176) of the rear carriage catch (174) is moved rearward sufficiently to allow the keeper (180) to clear the lip (286) of the trigger guard assembly (96). (FIG. 2). The trigger guard (20) is then utilized to rotate the carriage assembly (18) in a counter-clockwise rotation around the flat sided pin (56). Means are provided for releasably engaging the hammer (66) when the carriage assembly (18) is pivoted in a first direction and for releasing the hammer (66) when the carriage assembly (18) is pivoted in a second direction. In the preferred embodiment, the engaging and releasing means is the primer pocket (224). As the carriage assembly (18) rotates, the primer pocket (224) motivates the hammer (66) in a counter-clockwise rotation. As the carriage assembly (18) rotates, the outward catch (80) of the hammer (66) contacts the sloped nose (206) of the hammer catch (194). The sloped nose (206) biases the hammer catch (194) rearward against the tension of the spring (208) until the outward catch (80) passes the nose (206), and allows the spring (208) to again motivate the hammer catch (194) forward. As shown in FIG. 12, the nose (206) of the hammer catch (194) is shaped with a flat bottom to prevent the outward catch (80) from passing by the hammer catch (194) in a clockwise motion until the hammer catch (194) is motivated rearward.

Figure 13:
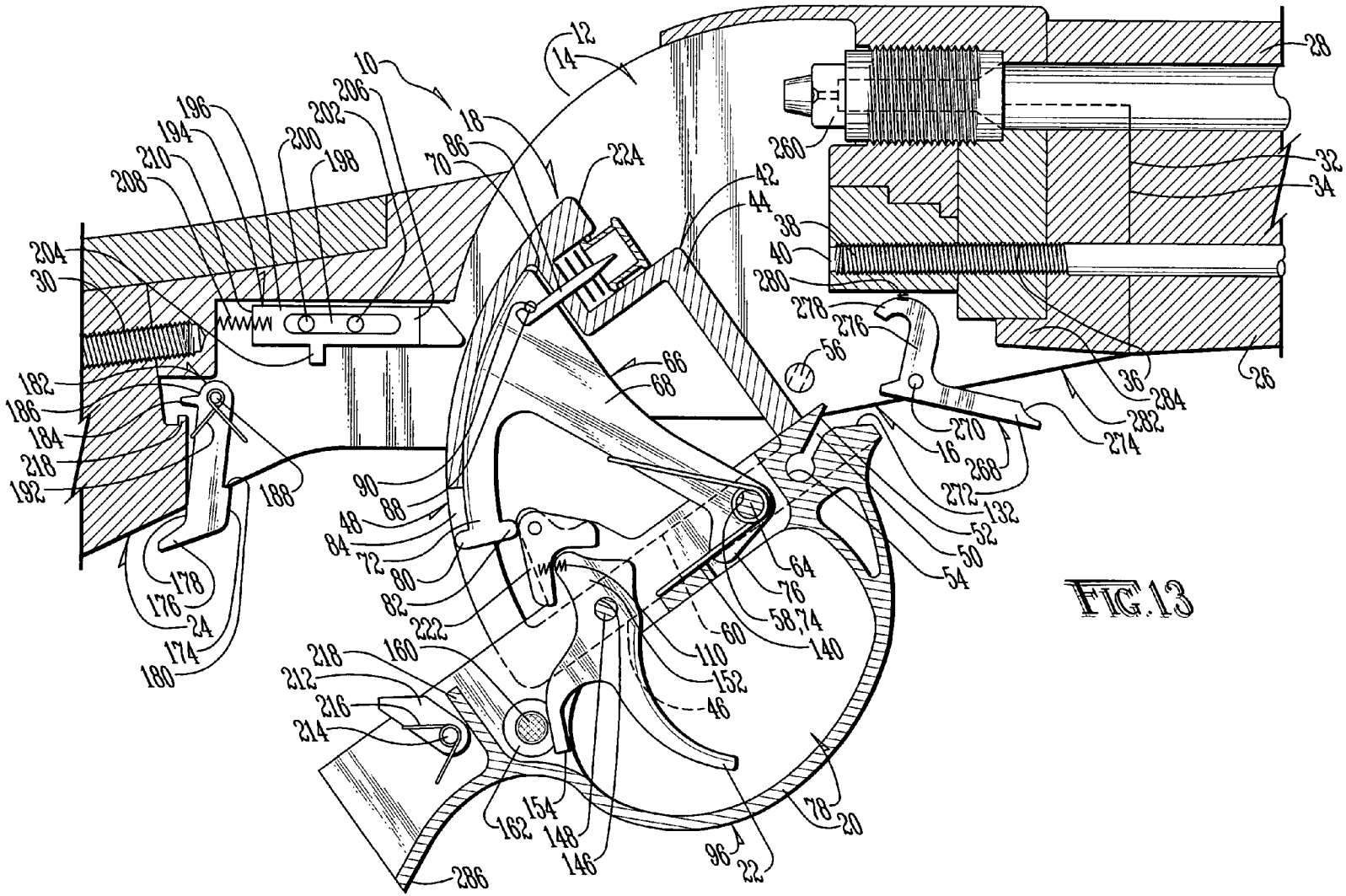
FIG. 13 illustrates a side elevation in cross-section of the improved action of FIG. 1, showing the action being removed from the frame.

Means are provided for preventing the carriage assembly (18) from pivoting to a sufficient predetermined angle to allow the carriage assembly (18) to disengage from the frame (12). In the preferred embodiment, this means is the forward carriage release (268). If it is desired to remove the entire carriage assembly (18) for cleaning, inspection or repair, a finger of a user (not shown) may be placed into the recess (282) to engage the finger recess (274) of the forward carriage release (268). Using the trigger guard (20) as a handle, the forward carriage release (268) is rotated clockwise against the compression spring (280) until the catch plate (278) is retracted sufficiently so as to allow the stop (132) of the trigger guard assembly (96) to pass. To release the carriage assembly (18) the carriage assembly (18) must be rotated enough to align the flat sided pin (56) with the walls (52), to allow the flat sided pin (56) to move through the slot (50) and allow the carriage assembly (18) to disengage from the rest of the firearm (10). (FIG. 13). Although the flat sided pin (56) and slot (50) may be constructed of any suitable design or orientation, in the preferred embodiment, the flat sided pin (56) and slot (50) are oriented so that the flat sided pin (56) can slide through the slot (50) when the carriage assembly is oriented at an angle greater than thirty degrees, more preferably greater than forty degrees, and most preferably, forty-five degrees. Whatever angle for release is selected, it is important that the forward carriage release (268) and stop (132) be constructed in a manner such that the carriage assembly (18) cannot be released from the remainder of the firearm (10) unless the forward carriage release (268) has been manually rotated in a clockwise manner.

After the carriage assembly (18) has been inspected, cleaned and/or repaired, the carriage assembly (18) is moved into the frame (12) with the flat sided pin (56) provided through the slot (50), until the flat sided pin (56) reaches the circular recess (54). The forward carriage release (268) may then be manually rotated in a clockwise manner sufficiently to allow the stop (132) to clear the catch plate (278) as the carriage assembly (18) is rotated in a clockwise manner. Once the stop (132) has cleared the catch plate (278), the forward carriage release (268) may be released.

Figure 14:
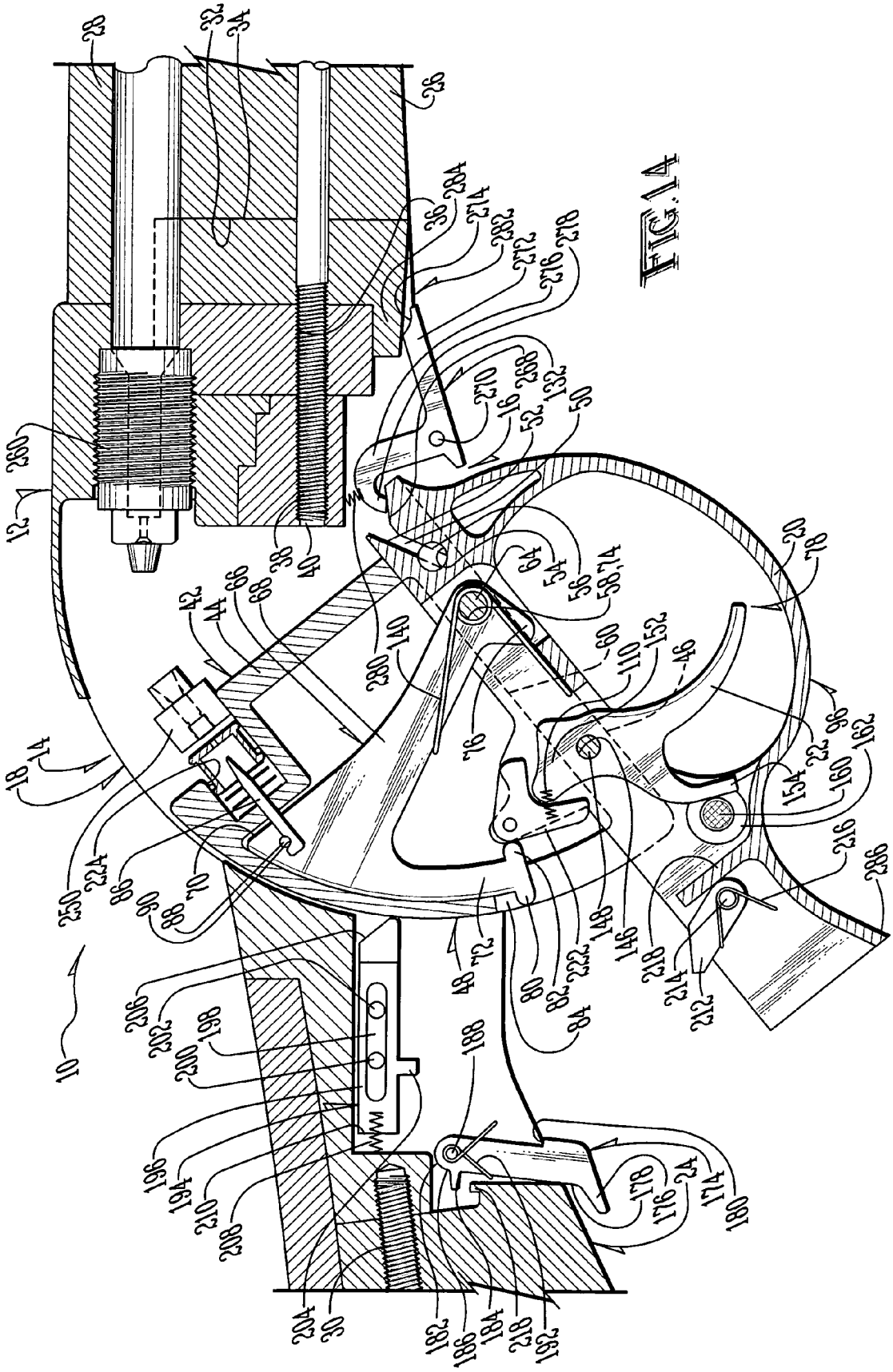
FIG. 14 illustrates a side elevation in cross-section of the improved action of FIG. 1, shown as an ignition system is inserted into the frame.
Figure 15:
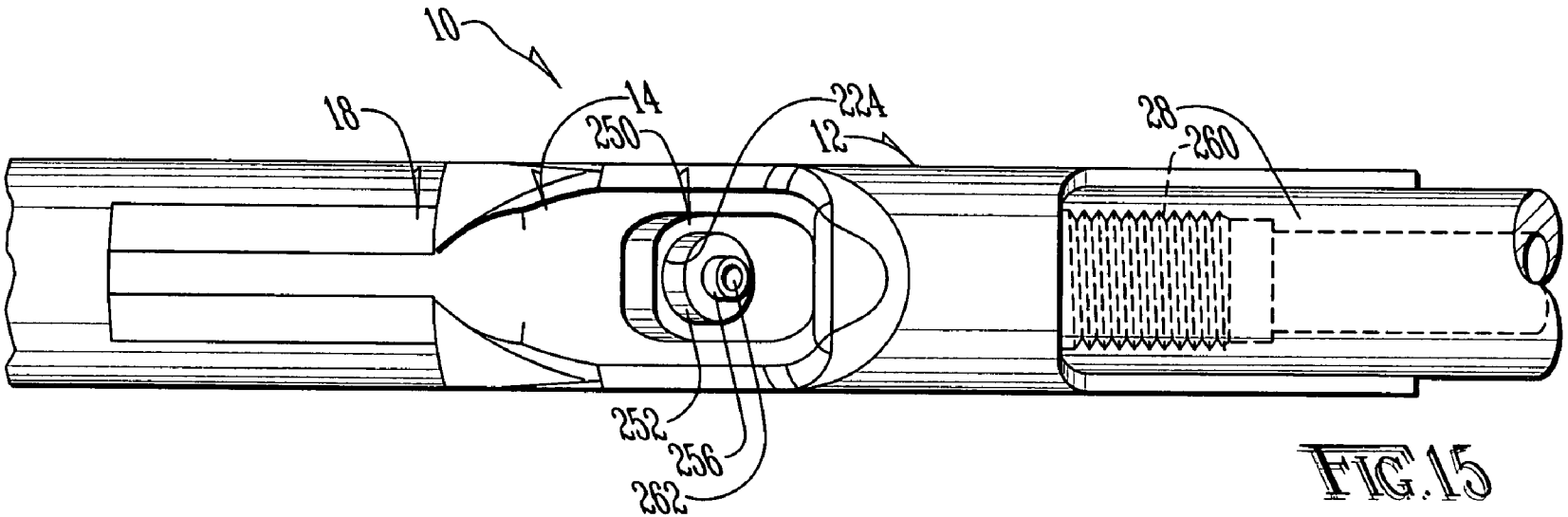
FIG. 15 illustrates a top elevation of the improved action of FIG. 1, shown with the ignition system being moved into battery.
Figure 16:
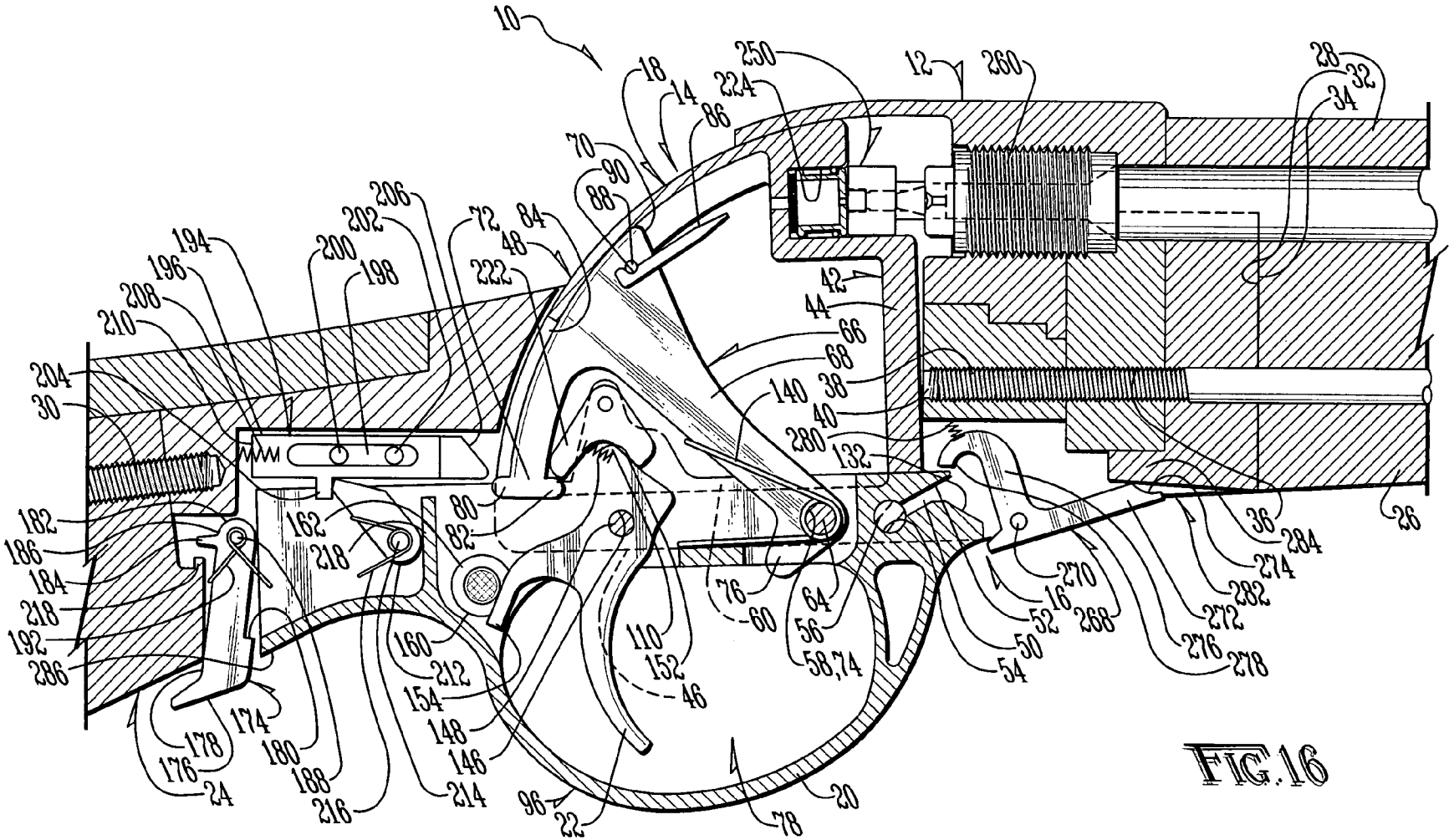
FIG. 16 illustrates a side elevation in cross-section of the improved action of FIG. 1, shown immediately prior to the ignition system being engaged into battery.

If it is desired to fire the firearm (10) the carriage assembly (18) is rotated as described above sufficiently to allow the carriage assembly (18) to clear the upper aperture (14) in the frame (12). The ignition system (250) is then inserted into the primer pocket (224) until it rests in an orientation such as that shown in FIGS. 8, 14 and 15. Once the ignition system (250) has been so positioned, the carriage assembly (18) is rotated clockwise until the trigger guard assembly (96) contacts the rear carriage catch (174). (FIG. 16). The angle of both the trigger guard assembly (96) and the rear carriage catch (174) allow the rotation of the trigger guard assembly (96) to push the rear carriage catch (174) against the torsion of the torsion spring (192). Contact of the beak (184) with the hammer catch (194) prevents the rear carnage catch (174) from over rotating through either manual motivation or motivation by the trigger guard assembly (96). As the carriage assembly (18) rotates, the nose (206) of the hammer catch (194) engages the outward catch (80) of the hammer (66). To cock the hammer (66), means are provided for engaging the hammer (66) against pivoting relative to the frame (12) when the carriage assembly (18) is rotated in a clockwise rotation. In the preferred embodiment, the engaging means is the sear (222), which engages the inward catch (82), thereby preventing the hammer (66) from rotating with the carriage assembly (18).

As the carriage assembly (18) moves into battery, the release lever (212) engages the catch block (204) of the hammer catch (194), motivating the hammer catch (194) rearward against the motivation against the spring (208) and out of contact with the outward catch (880) of the hammer (66). Accordingly, once the carriage assembly (18) has been moved into battery as shown in FIG. 16, the release lever (212) has completely motivated the hammer catch (194) out of engagement with the outward catch (80) of the hammer (66). Thereafter, only the sear (222) prevents the hammer (66) from moving rapidly clockwise in response to the motivation of the double torsion spring (140).

Figure 17:
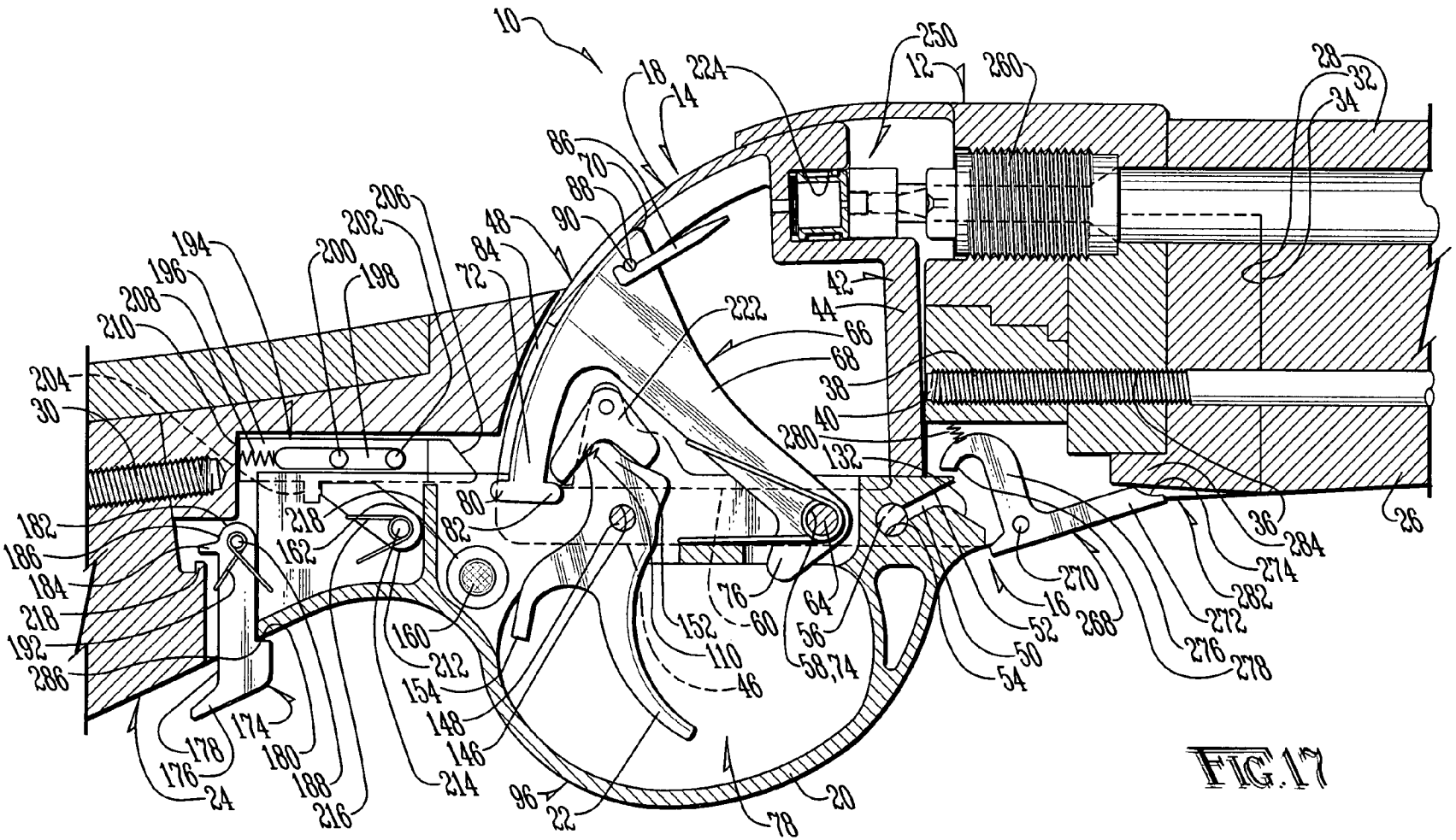
FIG. 17 illustrates a side elevation in cross-section of the improved action of FIG. 1, shown in battery.

Once the carriage assembly (18) has been moved into battery, the lip (286) is received by the keeper (180) of the rear carriage catch (174), thereby locking the carriage assembly (18) into battery. As shown in FIG. 17, when the hammer is cocked, the nib (76) extends into the finger area (78), allowing a user to immediately determine by feel whether the hammer is cocked. As shown in FIGS. 10 and 17, when the carriage release (18) is in battery, the breech plug (260) positions the ignition system (250) and retractable face (232) into positions which allow the primer (254) to come in contact with the firing pin (86) as the hammer (66) is thrown.

Figure 18:
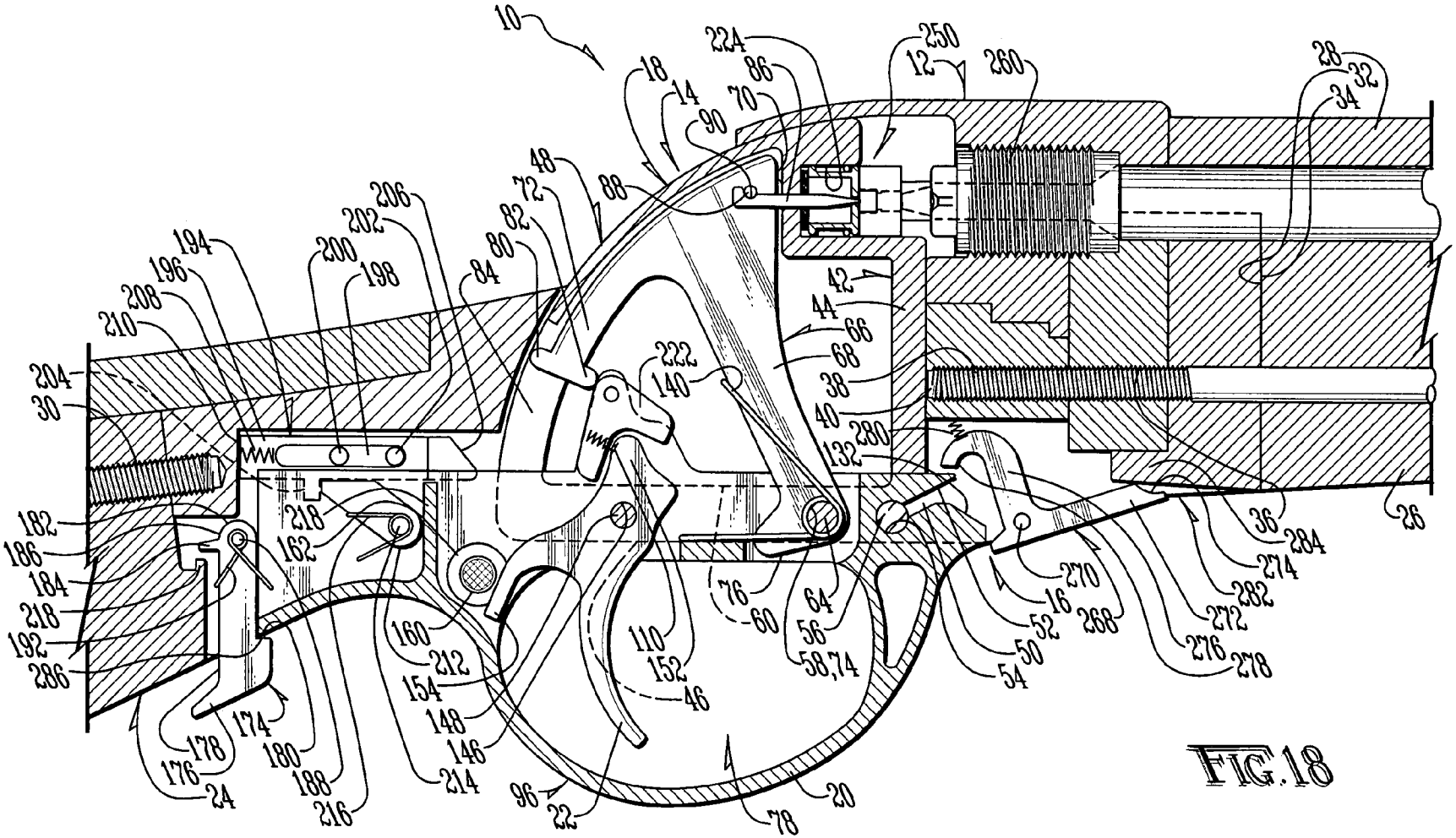
FIG. 18 illustrates a side elevation in cross-section of the improved action of FIG. 1, showing the action in the fired position.

When it is desired to fire the firearm (10), the safety pin (160) is moved from the position shown in FIG. 5 to the position shown in FIG. 6 to allow the trigger (22) to rotate. Once the safety pin (160) has been released, the trigger (22) may be rotated. The trigger (22) is rotated sufficiently to cause the sear engagement head (152) to engage the sear (222) to move the sear (222) out of engagement with the inward catch (82) of the hammer (66). This action allows the double torsion spring (140) to motivate the hammer (66) and firing pin (86) clockwise. As shown in FIGS. 10 and 18, as the hammer (66) rotates, the firing pin (86) enters the primer pocket (224) through the hole (242), and into contact with the primer (254). Contact with the primer (254) ignites a plasma charge which travels through the bore (262) of the jacket (252), and through the bore (262) of the breech plug (260) to ignite a powder or similar charge (not shown) located within the barrel (28) to propel a projectile (not shown). The frame (12) acts as a shield to direct smoke and shrapnel downward. As shown in FIG. 18, once the firearm (10) has been fired, the nib (76) no longer extends into the finger area (78) of the trigger guard (20), thereby allowing a user to readily determine that the hammer (66) is not cocked. The firearm (10) may then be reloaded, cleaned or stored.

As noted above, an important feature of the present invention is the coverage of the aperture (14) by the back strap (48) of the carriage (42) during firing. This coverage directs smoke, debris and concussion away from a user's face and out of the sight line of the firearm (10). When it is desired to rearm the weapon, the foregoing process is repeated, with the spent ignition system (250) being removed through the aperture (14) and replaced with a new ignition system (250).

Although the invention has been described with respect to a preferred embodiment thereof, it to be also understood that is not to be so limited, since changes and modifications can be made therein which are within the full, intended scope of this invention as defined by the appended claims. Furthermore, although all assemblies described herein are preferably constructed within a 90% variance, and more preferably within a 25% variance from the dimensions listed above, they may be constructed of any suitable size or materials.

What is claimed is:

1. An improved action in a firearm having a grip, a receiver, a forwardly extending barrel and a trigger assembly, the improvement comprising:

(a) a frame;

(b) a hammer pivotably coupled to said frame;

(c) a carriage;

(d) means provided on said carriage for releasably engaging said hammer when said carriage is pivoted in a first direction and for releasing said hammer when said carriage is pivoted in a second direction, wherein said first direction is substantially opposite said second direction; and (e) means for pivotably coupling said carriage to said frame in a manner which allows said carriage to disengage from said frame upon pivoting the carriage a predetermined angle in relation to said frame.

2. The improved action in a firearm of claim 1, further comprising a firing pin coupled to said carriage.

3. The improved action in a firearm of claim 1, further comprising means for preventing said carriage from pivoting said predetermined angle relative to said frame.

4. The improved action in a firearm of claim 1, further comprising means for engaging said hammer against pivoting relative to said frame when said carriage is pivoted in said second direction.

5. The improved action in a firearm of claim 1, wherein said carriage is provided with an ignition system holder.

6. The improved action in a firearm of claim 5, further comprising a shield rigidly coupled to said frame over said ignition system when said ignition system is in battery.

7. The improved action in a firearm of claim 6, wherein said frame is provided with an opening greater than one square centimeter in size.

8. The improved action in a firearm of claim 3, further comprising a catch coupled to said carriage, wherein said preventing means comprises:

(a) a keeper;

(b) a tab coupled to said keeper; and (c) wherein said preventing means is pivotable between a first position in which said keeper contains said catch in a manner which prevents said carriage from pivoting through said predetermined angle relative to said frame, and a second position in which said keeper allows said carriage to pivot through said predetermined angle relative to said frame.

9. The improved action in a firearm of claim 1, further comprising a sear pivotably engagable with said hammer.

10. The improved action in a firearm of claim 9, wherein said sear is positioned substantially within said carriage.

11. The improved action in a firearm of claim 9, wherein said sear is pivotably coupled to said frame at a position which is over one centimeter relative to a point at which said sear engages said hammer.

12. The improved action in a firearm of claim 9, wherein said hammer pivots about an axis and wherein said sear is pivotably coupled to said frame at a first point which is further from said axis than a second point at which said sear engages said hammer.

13. The improved action in a firearm of claim 12, wherein said hammer comprises a shaft and a striker and wherein said striker has a head having a top, wherein said first point and said second point are located closer to said axis than said top of said head of said striker.

14. The improved action in a firearm of claim 1, wherein said carriage pivots on a first axis, and wherein said hammer pivots on a second axis, wherein said first axis is different than said second axis.

15. An improved action in a firearm having a grip, a receiver, a forwardly extending barrel and a trigger assembly, the improvement comprising:

(a) a receiver;

(b) a carriage coupled for pivotable movement within said receiver;

(c) a hammer coupled for pivotable movement within said carriage;

(d) a handle coupled to said carriage;

(e) means for allowing said carriage to be removed from said receiver upon pivoting said carriage a predetermined angle relative to said receiver; and (f) means provided on said carriage for engaging and pivoting said hammer in a first direction upon pivoting said carriage in said first direction.

16. The improved action in a firearm of claim 15, further comprising a firing pin coupled to said carriage.

17. The improved action in a firearm of claim 16, wherein said firing pin is secured to said hammer.

18. A firearm comprising:

(a) a grip, (b) a receiver, (c) a forwardly extending barrel, (d) and an action comprising:

(i) a receiver;

(ii) a carriage pivotable within said receiver about a first axis;

(iii) a hammer pivotable about a second axis;

(iv) a catch pivotably moveable between a first position and a second position; and (v) means coupled to said carriage for allowing said carriage to be removed from said receiver when said catch is in said first position and for preventing said carriage from being removed from said receiver when said catch is in said second position.

19. The improved action in a firearm of claim 18, wherein said carriage pivots on a first axis, and wherein said hammer pivots on a second axis, wherein said first axis is different than said second axis.

20. The improved action in a firearm of claim 18 further comprising means provided on said carriage for releasably engaging said hammer when said carriage is pivoted in a first direction and for releasing said hammer when said carriage is pivoted in a second direction, wherein said first direction is substantially opposite said second direction.

* * * * *